United States Patent [19]

Shaw et al.

[11] 4,174,964

[45] Nov. 20, 1979

[54] NICKEL-BASE ALLOYS OF IMPROVED HIGH TEMPERATURE TENSILE DUCTILITY

[75] Inventors: Stuart W. K. Shaw, Sutton Coldfield; Paul I. Fontaine, Solihull, both of England

[73] Assignee: The International Nickel Company, Inc., New York, N.Y.

[21] Appl. No.: 436,539

[22] Filed: Jan. 25, 1974

Related U.S. Application Data

[63] Continuation-in-part of Ser. No. 191,544, Oct. 21, 1971, abandoned, which is a continuation-in-part of Ser. No. 84,528, Oct. 27, 1970, abandoned.

[30] Foreign Application Priority Data

Oct. 28, 1969 [GB] United Kingdom ..... 52821/69

[51] Int. Cl.[2] ..... C22C 19/03

[52] U.S. Cl. ..... 75/122; 75/134 F; 75/170; 75/171; 148/32.5

[58] Field of Search ..... 75/171, 170, 122, 134 F; 148/32, 32.5

[56] References Cited

U.S. PATENT DOCUMENTS

| | | | |
|---|---|---|---|
| 3,164,465 | 1/1965 | Thielemann | 75/171 |
| 3,516,826 | 6/1970 | Ward et al. | 75/171 |
| 3,667,938 | 6/1972 | Boesch | 75/171 |

*Primary Examiner*—R. Dean

*Attorney, Agent, or Firm*—Raymond J. Kenny; Ewan C. MacQueen

[57] ABSTRACT

The tensile ductility of low chromium substantially precipitation hardened nickel-base alloys within the temperature range of 600° C. to 900° C. is improved through the incorporation in the alloys of controlled amounts of yttrium.

4 Claims, No Drawings

NICKEL-BASE ALLOYS OF IMPROVED HIGH TEMPERATURE TENSILE DUCTILITY

This is a continuation-in-part of application Ser. No. 191,544, filed Oct. 21, 1971, abandoned which in turn was a continuation-in-part of Ser. No. 84,528, filed Oct. 27, 1970, abandoned.

The present invention is directed to nickel alloys, and is particularly addressed to the problem of improving the tensile ductility of precipitation-hardenable, cast nickel-base alloys over the temperature range of 600° C. to 900° C., particularly 700° to 800° C.

As is known to those skilled in the art, over the past 20 years or so, demands upon research have been continuous in an effort to develop alloys and components fabricated therefrom capable of withstanding the more stringent requirements imposed by advanced designs, special applications, etc. Improvements achieved in the aircraft and related industries are particularly notable in this regard as is evident from the many innovations brought about in respect of gas turbine engines. For example, alloys for stator and rotor blades have been developed which are now capable of meeting operating conditions of high stress at elevated temperatures upwards of 980° C. to about 1100° C.

Yet, notwithstanding the extensive research efforts heretofore expended it has been a problem in the manufacture of high-temperature nickel-base alloys, such as those suitable for steam or gas turbine applications, to obtain higher levels of ductility over the temperature range of 600° 1 C. to 900° C., particularly while otherwise retaining satisfactory properties such as high rupture strength, creep resistance and adequate corrosion resistance. The problem, which has received attention elsewhere in recent years, has been especially marked in respect of the low-chromium alloys which also contain substantial amounts of the precipitation hardening ingredients aluminum and titanium. In particular, it has been found that these alloys generally exhibit a ductility trough between 600° C. and 900° C., notably at a temperature of 700° C. to 800° C., which can lead to premature failure of articles and parts operating within this temperature range.

It has now been discovered that the above-described tensile ductility of low chromium, substantially precipitation hardened, cast nickel-base alloys can be improved through the incorporation of special amounts of yttrium.

Generally speaking, the present invention contemplates providing precipitation-hardenable, nickel-base alloys, notable cast alloys, and steam or gas turbine components produced therefrom, the alloys having improved tensile ductility in the hardened condition and containing, by weight, up to 10.5%, e.g., 2% to 10%, chromium; up to 20%, e.g., 5% to 16%, cobalt; up to 25%, e.g., 7% to 21%, tungsten; up to 3% or 5% iron; up to 10%, e.g. 1% to 7%, molybdenum; from 4% to 12%, e.g., 5.5% to 10%, of titanium plus aluminum; up to 12%, e.g., 0.5% to 9%, tantalum; up to 6%, e.g., 1% to 4.5%, niobium; up to 2% or 3% vanadium; up to 1.5%, e.g., 0.05% to 1%, zirconium; up to 0.3%, e.g., 0.001% to 0.05%, boron; from 0.005% to 0.15% of yttrium, the balance being essentially nickel. Advantageously, the alloys contain from 0.02% to 0.12%, e.g., 0.05% to 0.1%, of yttrium. The alloys may also contain up to 0.5% of carbon, up to 0.5% of manganese and up to 0.3% of silicon.

Yttrium has been added to nickel-base alloys heretofore, generally for the purpose of conferring oxidation resistance. However, insofar as we are aware, yttrium has not been proposed for the purpose of enhancing tensile ductility over the above-described temperature range in low chromium, nickel-base alloys greatly hardened with aluminum and/or titanium. Moreover, as will be demonstrated herein, we have found that the respective percentages of this element must be carefully controlled if improved ductility is to be obtained.

In carrying the invention into practice, the alloys of the invention are normally produced by vacuum melting, for example, in a vacuum induction furnace, followed by the addition of yttrium, and then cast, preferably in an inert atmosphere under vacuum. If desired, before such an addition, the alloys can be subjected to vacuum refining, for example, by vigorously agitating the molten alloy in a vacuum induction furnace for an extended period of time, e.g., from 15 to 60 minutes at 1400° C. to 1600° C., preferably under a pressure not exceeding 10 microns and more preferably not exceeding 2 microns, and thereafter admitting an inert gas, e.g., argon, to a moderate pressure, e.g., 100 mm. mercury. The said addition is then made followed by casting of the melt. A preferred vacuum refining operation is effected in a vacuum induction furnace for about 30 minutes under a pressure of about 1 micron with the crucible set wholly within the furnace induction coil and being between one and two thirds filled with melt to thereby maintain vigorous agitation throughout. Thus, the upper part of the coil will be above the normal level of melt in the crucible, and when the furnace is in operation, this arrangement increases the intensity of agitation to which the melt is subjected.

To illustrate the improved ductility obtained as described above, the following examples and illustrative data are given:

A 50 kg. heat of each of several alloys (Alloys 1–4, Table I) was made in a 55 kg. capacity 3 k/c vacuum induction furnace and held at 1500° C. under approximately 1 micron pressure for 30 minutes.

TABLE I

| | C % | Cr % | Co % | Mo % | W % | Nb % | Ta % | Ti % | Al % | Zr % | B % | Ni % |
|---|---|---|---|---|---|---|---|---|---|---|---|---|
| 1 | 0.1 | 8.1 | 9.9 | 6.05 | — | — | 4.1 | 0.95 | 5.75 | 0.12 | 0.019 | Bal. |
| 2 | 0.1 | 10.1 | 10.0 | 4.05 | — | — | — | 3.65 | 5.8 | 0.14 | 0.015 | Bal. |
| 3 | 0.13 | 5.8 | — | 2.02 | 10.9 | 1.40 | — | — | 6.7 | 0.13 | 0.018 | Bal. |
| 4 | 0.15 | 9.1 | 10.0 | 2.2 | 9.8 | — | 1.5 | 1.3 | 5.5 | 0.05 | 0.018 | Bal. |

The heats were cast as 10 kg. sticks for remelting in conventional manner. The sticks were cut into 4 kg. portions which were remelted in a 10 kg. 4 k/c vacuum induction fuunace. Various amounts of yttrium were added (Table II) under argon at a pressure of 100 mm. of mercury to the 4 kg. melts and the resultant melt in each case was cast into a preheated refractory mold to provide suitably tapered test piece blanks. Test bars were machined from the blanks and were subjected to short time tensile, creep and stress-rupture tests, the results being given in Table II.

TABLE II

| | | Tensile Properties at 760° C. | | Creep and Stress-Rupture Properties at 760° C. | | | | Creep and Stress-Rupture Properties at 980° C. | | | |
|---|---|---|---|---|---|---|---|---|---|---|---|
| Alloy No. | Addition (%) | Elong. at Fracture (%) | U.T.S. (h.bar) | Stress (h.bar) | Creep Strain 2 hrs. prior to Fracture (%) | Elong. at Fracture (%) | Rupture Life (h.) | Min. Creep Rate (% /h.) | Stress (h.bar) | Rupture Life (h.) | Elong. at Fracture |
| | Nil | 4.8, 4.1 | 86.7, 89.3 | 65 | 1.90, 2.14 | 3.2, 3.6 | 10, 11 | 0.140 | 20 | 91, 56 | 7.8, 8.4 |
| | 0.01 Y | 5.8 | 91.5 | 65 | 3.02 | 4.4 | 20 | — | 20 | 46 | 10.2 |
| 1 | 0.05 Y | 7.5 | 88.0 | 65 | 3.10 | 4.8 | 22 | 0.075 | 20 | 32 | 5.6 |
| | 0.08 Y* | 7.1 | 99.0 | 65 | 5.29 | 6.5 | 78 | 0.039 | 20 | 44 | 4.2 |
| | 0.18 Y* | 4.4 | 91.1 | 65 | 4.67 | 5.9 | 34 | — | 20 | 45 | 3.8 |
| 2 | Nil | 3.1, 2.4 | 85.9, 82.6 | 60 | — | 3.1, 3.4 | 47, 82 | — | 15 | 73, 77 | 19.5, 21.7 |
| | 0.05 Y* | 10.2 | 98.0 | 60 | — | 7.6 | 142 | — | 15 | 97 | 15.8 |
| | Nil | 1.1, 0.9 | 83.1, 82.7 | 65 | — | 1.7 | 16 | — | 20 | 45 | 6.4 |
| 3 | 0.05 Y | 2.8 | 88.5 | — | — | — | — | — | — | — | — |
| | 0.085 Y* | — | — | 65 | — | 3.3 | 87 | — | 20 | 38 | 9.7 |
| | 0.17 Y* | 0.9 | 80.8 | — | — | — | — | — | — | — | — |
| | Nil | 2.0 | 88.5 | 65 | — | 2.2 | 93 | — | 20 | 87 | 5.8 |
| 4 | 0.05 Y | 2.2 | 91.0 | 65 | — | 5.5 | 139 | — | 20 | 85 | 6.5 |
| | 0.07 Y | 2.3 | 91.4 | 65 | — | 4.7 | 160 | — | 20 | 92 | 5.8 |

* = analyzed percentage
1 h. bar - 1450 psi

As can be seen from the data in Table II, alloys which contained from 0.01% to 0.1% yttrium generally exhibited considerably higher ductility in comparison with the same alloys to which this constituent was not added. It is to be emphasized, however, that as reflected by the data, an excessive quantity (0.18%) of yttrium negates the improvement. In some instances other properties were improved at the 760° C. test temperature, but at 980° C. some reduction in properties was experienced.

Examples of other alloys for which the tensile ductility can be improved by the addition of yttrium in accordance with the invention are given in Table III.

TABLE III

| Alloy | C % | Cr % | Co % | Mo % | W % | Ta % | Al % | Zr % | B % |
|---|---|---|---|---|---|---|---|---|---|
| 5 | 0.1 | 3 | 12 | — | 19 | 3 | 5.75 | 0.35 | 0.03 |
| 6 | 0.08 | 5 | 15 | 3.5 | 8 | 8 | 6 | 0.05 | 0.10 |

It will be noted that Alloys 5 and 6 as well as Alloys 1–4 all contain at least 5% and up to close to 7% aluminum. The invention is particularly applicable to such precipitation hardenable nickel-base alloys.

In addition to manufactured components such as stator and rotor blades and turbine rotors, alloys in accordance herewith, particularly as castings, are useful as components in automotive and aircraft turbine applications generally; and also as dies, parts for furnaces and heaters, and the like (such products are collectively referred to as "components"). This applies particularly with regard to cast low chromium, highly precipitation hardened nickel-base alloys.

Although the present invention has been described in conjunction with preferred embodiments, it is to be understood that modifications and variations may be resorted to without departing from the spirit and scope of the invention, as those skilled in the art will readily understand. In this regard, a percentage range of one constituent can generally be used with a given range of another constituent.

We claim:

1. As a new article of manufacture, a cast metal component having improved tensile ductility within the temperature range of about 700° C. to about 800° C., particularly about 760° C., said component being formed of an alloy consisting essentially of up to 10.5% chromium, from 4% to 12% in total of titanium plus aluminum, up to 20% cobalt, up to 25% tungsten, up to 10% molybdenum, up to 12% tantalum, up to 6% niobium, up to 5% iron, up to 3% vanadium, up to 1.5% zirconium, up to 0.5% carbon, up to 0.5% manganese, up to 0.3% silicon, up to 0.3% boron, and from 0.005% to 0.15% yttrium, the balance being essentially nickel.

2. An article of manufacture in accordance with claim 1 wherein the cast metal component is formed from a vacuum melted alloy which contains from 0.02% to about 0.08% of yttrium.

3. A cast metal component as set forth in claim 1 in which the aluminum content is from 5% to 7%.

4. As a new article of manufacture, a cast metal component having improved tensile ductility within the temperature range of about 700° C. to about 800° C., particularly about 760° C., said component being formed of an alloy consisting essentially of about 3% to about 10.1% chromium, up to 3.65% titanium, about 5.5% to 6.7% aluminum, up to about 15% cobalt, up to about 19% tungsten, up to about 8% tantalum, up to about 6.05% molybdenum, up to about 1.4% niobium, about 0.05% to about 0.35% zirconium, about 0.015% to 0.1% boron, about 0.08% to about 0.15% carbon, about 0.01% to about 0.085% yttrium, and the balance essentially nickel.

* * * * *